United States Patent [19]

Fulton

[11] 4,293,009

[45] Oct. 6, 1981

[54] PRESSURIZED GAS FILLING HEAD

[76] Inventor: Hugh C. Fulton, 2A Akatea Rd., Glen Eden, Auckland, New Zealand

[21] Appl. No.: 74,333

[22] Filed: Sep. 11, 1979

[30] Foreign Application Priority Data

Sep. 12, 1978 [NZ] New Zealand ..... 188395

[51] Int. Cl.[3] ..... B65B 3/04

[52] U.S. Cl. ..... 141/311 R; 141/383; 141/392

[58] Field of Search ..... 141/285, 287, 301, 302, 141/305, 311 R, 312, 346, 347, 382–386, 392

[56] References Cited

U.S. PATENT DOCUMENTS 4,207,934 6/1980 Scremin et al. ..... 141/383

*Primary Examiner*—Frederick R. Schmidt

*Attorney, Agent, or Firm*—Young & Thompson

[57] ABSTRACT

A clamp on gas cylinder filling head comprising an on/off valve and incorporating a bobbin which is extended by the initial pressure of the gas to be transferred. The bobbin, in conjunction with a clamp bar being an integral part of the head and spaced outwardly of the main body thereof clamps the head to and opens the inlet of a cylinder being charged. This halted movement of the bobbin causes a back-pressure within the head which forces a shuttle or spool valve mounted within a chamber of the gas inlet passage of the head to move from its state of rest to open the inlet passage to an outlet port to achieve discharge. Closing of the valve relieves the pressure within the head allowing return means for the bobbin to operate thus removing the clamping action thereof.

2 Claims, 2 Drawing Figures

PRESSURIZED GAS FILLING HEAD

BACKGROUND OF THE INVENTION

This invention relates to a gas cylinder filling head via which a gas cylinder can be charged under pressure from a parent pressurised gas supply.

SUMMARY OF THE INVENTION

A primary intention of this invention is to provide a gas cylinder filling head which can be mounted at the end of a hose connected, for example, to a parent oxygen bottle or similar gas supply and coupled to an underwater breathing cylinder or other appropriate gas storage cylinder to provide for the charging thereof with the gas of the supply. The filling head incorporates a valve and a clamp, the latter acting under the initial pressure of the gas being transferred to fasten the head to and open an inlet element of the cylinder to be charged. Conversely, closing of the valve removes the clamping action. It is envisaged that this will facilitate and render more safe such a gas transferring operation.

According to one aspect of this invention there is provided a gas cylinder filling head comprising a body incorporating a clamp bar spaced outwardly thereof, a gas inlet port adapted for connection to a pressurised gas supply, a gas outlet port disposed toward and spaced inwardly of the clamp bar, a control bore housing a two position, ON and OFF respectively, reciprocally operative control valve member, the ends thereof being disposed exteriorally of the body to form control buttons, the valve controlling, in opposing manner, a gas inlet passage extending from the inlet port to a delay chamber and a pressure release passage, a spool valve mounted and reciprocally operative in the delay chamber, the spool valve dividing the delay chamber into a central outlet sub-chamber conjoined to the outlet port and bobbin and inlet sub-chambers separated save for a restrictive passage extending through the spool, from each other, one to each end of the delay chamber with the cross-sectional area of the bobbin sub-chamber being larger that that of the inlet sub-chamber an annular shaped bobbin containing recess formed in the body about the inlet port and conjoining to the bobbin sub-chamber, the bobbin being axially slidable within the recess as to extend therefrom with the gas pressurisation of the recess whereby the bore of the bobbin will form an extension of the outlet port and whereby the bobbin will clamp, in conjunction with the clamp bar, the head to an inlet device of a gas cylinder to be charged, the gas back-pressure resulting from the halting of the bobbin movement dislodging the spool to thus conjoin the inlet and outlet sub-chambers enabling charging of the container, closing of the valve closing the inlet passage and opening the outlet passage to pressure relieve the filling head.

DETAILED DISCLOSURE OF THE INVENTION

Figure 1:
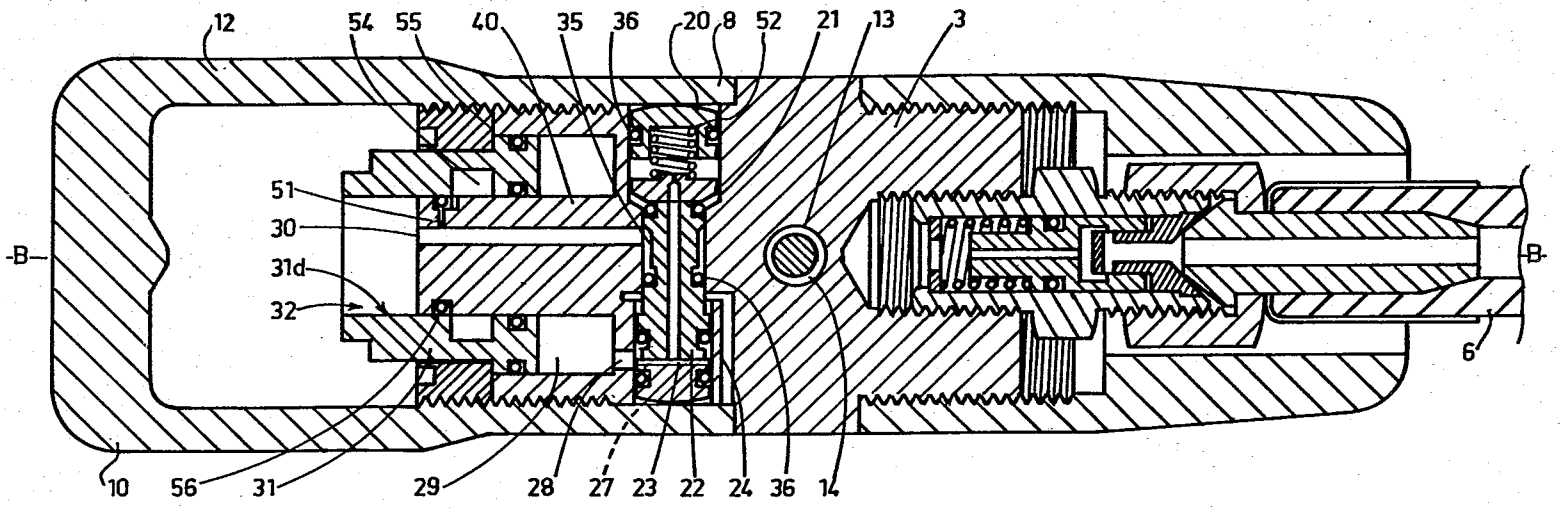
FIG. 1 is a longitudinal sectional view of the device.

A housing 3 is preferably machined by brass and incorporates an inlet port 5. Port 5 is adapted in any suitable known manner for the permanent coupling to a pressurised gas supply such as by a hose 6. A known type pressure compensating valve 59 is preferably incorporated in the inlet port 5. The housing 3 is preferably of a generally cylindrical form with inlet port 5 at one end. At the opposing end a clamp bar 10 is provided in an outwardly spaced relationship to the main body of the housing 3.

Clamp bar 10 preferably forms a bridging or yoke section supported by two lateral limbs 12 extending from an inner cylindrical section 8 forming a base for the limbs 12. Clamp bar 10 component is preferably formed separate to the body 3, mating screw-threads being provided on base 8 and body 3 for the assembly to one another. Clamp bar 10 preferably incorporates a central inwardly directed location nipple 11.

A diametrically disposed control bore 13 is formed though body 3 and accommodates a control valve member 14 which protrudes in the form of operating buttons 15 and **15*a* from each end thereof. Control member 14 is a sliding fit within bore 13, both bore 13 and control member 14 incorporating annular grooves in which "O" ring seals (more particularly specified hereinafter) are retained at appropriate intervals therealong to provide that control member 14 is operatively sealed with bore 13 and that a gas inlet passage 16 and a gas outlet passage 38 conjoining with bore 13 and controlled by valve member 14** are separated from each other.

Inlet port 5 conjoins by way of passage 16 with an inlet section of the bore 13. The inlet section is formed by an annular recess 17 about control member 14. When control member 14 is in the ON position, recess 17 conjoins with passage 16 and bridges an "O" ring seal 18 mounted in an annular groove in the wall of bore 13 to separate inlet passage 16 from a second inlet passage 19.

Passage 19 leads to an inlet sub-chamber 20 of a delay chamber 21 in which a reciprocally operative spool valve 22 is housed. Spool valve 22 divides chamber 21 into an inlet sub-chamber 20 at one end, conjoining with passage 19, a bobbin sub-chamber 24 at the other end and a central outlet sub-chamber 35 which conjoins with an outlet port 30. Spool 22 incorporates a restricted passage 23 axially therethrough which interconnects inlet sub-chamber 20 to bobbin sub-chamber 24. The cross-sectional area of bobbin sub-chamber 24 is larger than that of inlet sub-chamber 20 with the corresponding ends of spool 22 being similarly dimensioned. Thus, with a gas pressure build-up in chamber 21 spool 22 tends to be dislodged into inlet sub-chamber 20. Preferably a compression spring 52 is housed in inlet sub-chamber 20 to influence spool 22 toward bobbin sub-chamber 24, to facilitate the return of spool 22 with closing of valve member 14.

Outlet sub-chamber 35 is formed by an annular recess in the wall of spool 22 and sealed at each end thereof by "O" rings 36. With displacement of spool 22 into inlet sub-chamber 20, outlet sub-chamber 35 is conjoined to inlet sub-chamber 20 which is thus connected to outlet port 30.

The end wall of bobbin sub-chamber 24 incorporates recessed channels 27 in the face thereof which lead via passage 28 to an annular shaped recess 29 disposed about outlet port 30. Recess 29 is preferably disposed concentrically about port 30, they being separated by a wall 40. Slidingly retained in recess 29 is a cylindrically shaped bobbin 31 which, with pressurisation of recess 29, is influenced outwardly thereof such that the bore 32 thereof forms an extension of outlet port 30.

The extension of bobbin 31 is toward clamp bar 10 and this provides a clamping action therewith as will retain the inlet valve of for example, an oxygen bottle or cylinder positioned in the space therebetween. Locating nipple 11 assists alignment of the inlet by registering at the rear thereof, with the outlet port 30.

To provide for the return of bobbin 31 with the closing of valve member 14, an annular groove 54 is formed in the inner wall of bobbin 31. Innermost of groove 54 and also on the inner wall of bobbin 31 an "O" ring/-groove seal 55 is provided. In similar manner on the cooperating outer face of wall 40 outwardly of groove 54 a second "O" ring/groove seal 56 is provided. A bleed passage 51 extends from port 30 to the bottom of groove 56 and the "O" ring in groove 56 acts as a flap valve controlling bleed passage 51. More particularly, the entry of bleed passage 51 to groove 56 is marginally offset relative to the plane of "O" ring 56 and this allows gas seepage therepast in the direction from outlet port 30 to groove 54. In the reverse direction the "O" ring is drawn, owing to the pressure reduction, over the end of bleed passage 51 and thus groove 54 is sealed off. The bore diameter of the bobbin 31*d* is slightly larger than the diameter of the wall 40 so that gas in groove 54 can communicate with and is contained by "O" ring seals 55 and 56.

Thus, in using the device groove 54 is charged to the pressure of the gas being transferred and with closing of the valve remains sealed at that pressure. With release of the pressure in recess 29 the pressure in groove 54 acts on the "O" ring seal of sealing means 55 acting on the smaller diameter of wall 40 than of larger diameter 31*d* to return the bobbin.

An exhaust passage 38 connects outlet port 30 (by a space 32 formed when bobbin 31 is forward in a clamped position) to atmosphere. Passage 38 conjoins with control bore 13 by way of an external recess 39 formed in control member 14. When control 14 is closed recess 39 bridges an "O" ring/groove sealing means 57 formed in the wall of bore 13 to thus open exhaust passage 38.

Figure 2:
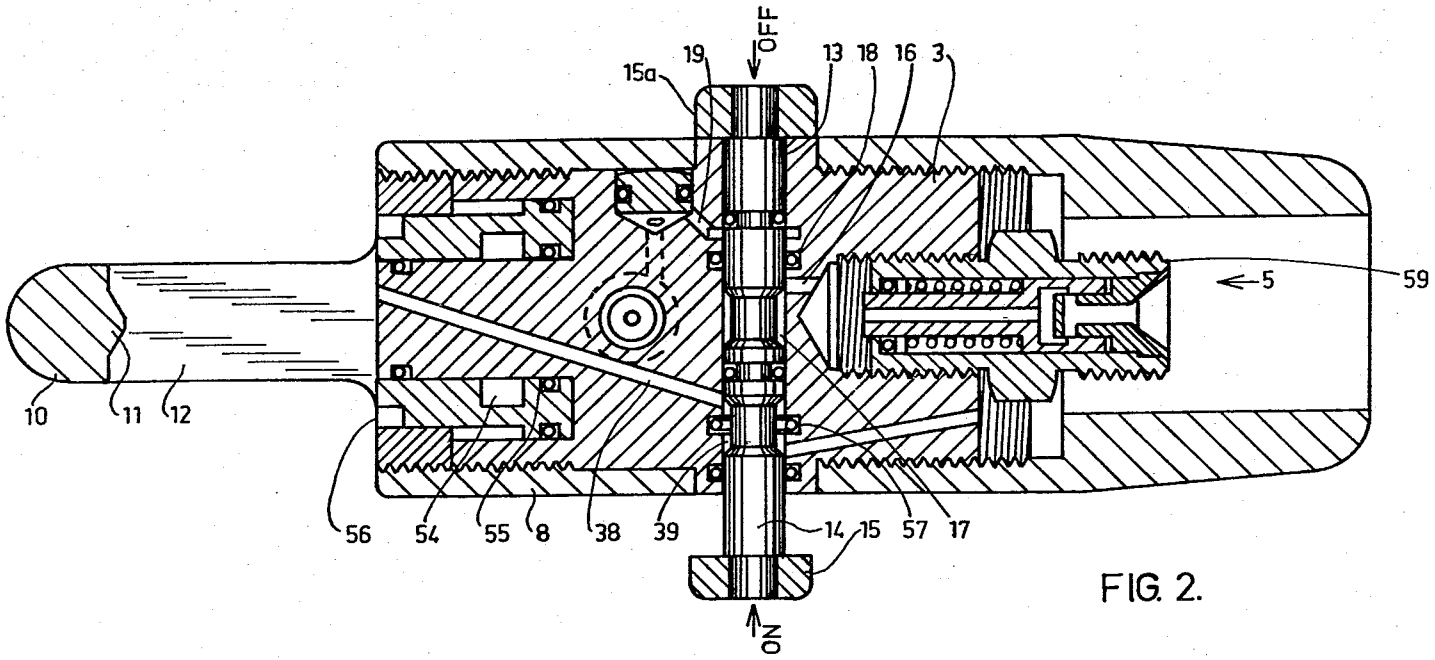
FIG. 2 is a further longitudinal sectional view of the device (without connecting hose) on line B—B on FIG. 1

In use, manually switching the device from the OFF position as depicted in FIG. 2 conjoins inlet port 5 via passage 16, recess 17 and passage 19 to sub-chamber 20. At rest spool 22 is influenced into sub-chamber 24 by the spring 52 or if there is no spring the initial gas pressure so positions spool 22. The gas bleeds via passage 23 and passages 27 and 28 to recess to 29 to force bobbin 31 outwardly as aforesaid. The resultant clamping halts the travel of bobbin 31 and the gas pressure build-up within recess 29 and sub-chamber 24 causes spool 22 to displace into sub-chamber 20. This conjoins inlet-sub-chamber 20 via outlet-sub-chamber 35 to outlet port 30 and thus a passage is provided for the transfer of the compressed gas.

When required, control member 14 is returned to the OFF position, thus connecting outlet port 30 to atmosphere via exhaust passage 38. The pressure within sub-chambers 20 and 24 and recess 29 is thus also relieved and the pressure within the bobbin return groove 54 returns the bobbin 31 to its inner position and releases the head from the container being charged.

What is claimed is:

1. A gas cylinder filling head having a body incorporating a clamp bar spaced outwardly thereof; said body including:

a gas inlet port adapted for connection to a pressurized gas supply, and a gas outlet port disposed towards and spaced inwardly of the clamp bar;

a control bore between said inlet and said outlet ports, said control bore housing a two position, ON and OFF respectively, reciprocally operative control valve member, the ends thereof being disposed on the exterior of the body to form control buttons;

a delay chamber having a spool valve reciprocally mounted therein, said spool valve dividing said delay chamber into:

(i) an inlet-sub-chamber (ii) an outlet-sub-chamber, and, (iii) a bobbin-sub-chamber;

the inlet-sub-chamber being at one end of the delay chamber with the bobbin-sub-chamber at the other end of the delay chamber, the bobbin-sub-chamber having a larger cross-sectional area than the inlet-sub-chamber, a restricted passage extending through said spool connecting said inlet-sub-chamber to said bobbin-sub-chamber;

means for biasing said spool valve towards said bobbin-sub-chamber;

the outlet-sub-chamber being adapted to interconnect the inlet-sub-chamber to the gas outlet when the spool valve moves away from the bobbin-sub-chamber and towards the inlet-sub-chamber;

an annular shaped recess formed in said body and adjacent the gas outlet port;

said recess communicating with said bobbin-sub-chamber;

a bobbin slidably mounted within said recess and capable of extending and clamping against the inlet of a gas cylinder to be charged when gas pressure is applied to said bobbin-sub-chamber and hence to said recess;

the bobbin having a bore therethrough which forms an extension of the gas outlet port when the bobbin is extended;

a gas inlet passage extending from said gas inlet port to said inlet-sub-chamber of the delay chamber and capable of being switched ON or OFF by said control valve member; and a pressure release passage connecting the gas outlet port to atmosphere and capable of being switched ON or OFF by said control valve member in opposition to the switching of said gas inlet passage;

whereby in use, switching of the control valve member to the ON position will allow gas pressure applied to the inlet port to firstly extend the bobbin into its clamping position and then to move the spool valve away from the bobbin-sub-chamber to connect the inlet-sub-chamber via the outlet-sub-chamber to the gas outlet port to enable gas to flow from said inlet port to said outlet port.

2. A gas cylinder filling head as claimed in claim 1, wherein said means for biasing said spool valve towards said bobbin-sub-chamber is a compression spring mounted within said inlet-sub-chamber.

* * * * *